US005339884A

United States Patent [19]

Angerman

[11] Patent Number: 5,339,884

[45] Date of Patent: Aug. 23, 1994

[54] SHOWER CURTAIN RING

[76] Inventor: Irving Angerman, 16 Easthaven La., White Plains, N.Y. 10605

[21] Appl. No.: 86,126

[22] Filed: Jul. 6, 1993

[51] Int. Cl.[5] ..... E06B 9/56

[52] U.S. Cl. ..... 160/330; 160/DIG. 6; 4/608; 16/87.2; 24/716

[58] Field of Search ..... 160/330, DIG. 6; D8/367, 373; 4/608, 609, 610, 558; 16/108, 87.2; 24/716

[56] References Cited

U.S. PATENT DOCUMENTS 2,840,155 6/1958 Stern ..... 16/87.2 X
3,772,734 11/1973 Kimel ..... 16/87.2
4,010,503 3/1977 Denton ..... 16/87.2
4,120,343 10/1978 Wilson ..... 4/608 X
4,308,637 1/1982 Kucera ..... D8/367

*Primary Examiner*—Blair M. Johnson
*Attorney, Agent, or Firm*—James & Franklin

[57] ABSTRACT

The shower curtain ring has a flexible body adapted to encircle a curtain rod and close by frictionally interengaging end members. One of the end members includes an elongated part which is received through an opening along the top edge of the curtain. A flange on the end of the elongated part retains the curtain even when the end members are not engaged. This facilitates installation of the curtain and prevents the curtain from falling off the ring should the end members accidentally disengage.

24 Claims, 3 Drawing Sheets

FIG. 5
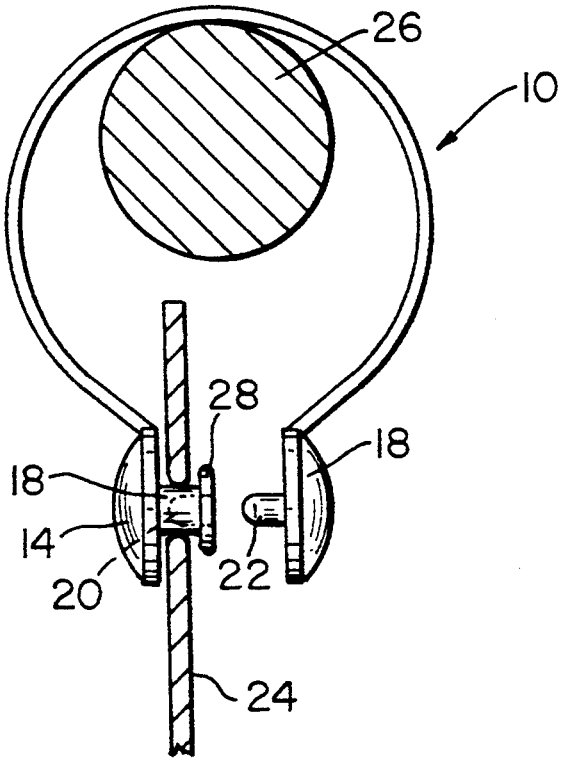
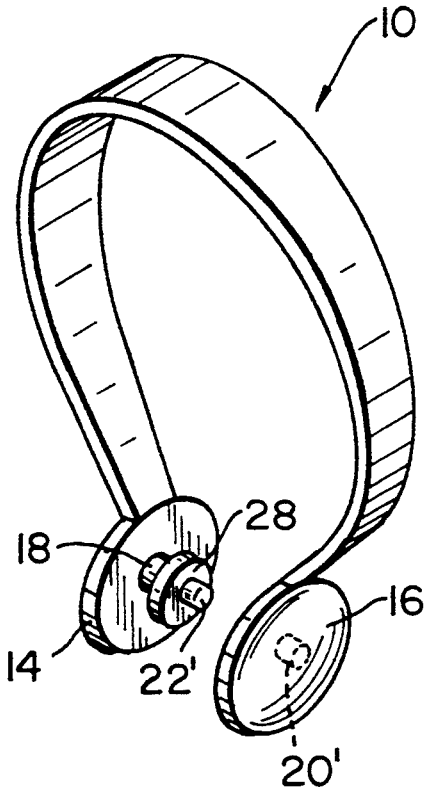
FIG. 6

SHOWER CURTAIN RING

The present invention relates to devices for hanging shower curtains on shower curtain rods and more particularly to an improved shower curtain ring which includes a means for retaining the shower curtain, even before the ring is closed, so as to facilitate installation of the shower curtain and to prevent the curtain from falling off the ring, should the ring accidentally open.

Plastic shower curtain rings are commonly used to hang shower curtains from shower curtain rods. Shower curtains are provided with a plurality of spaced openings along the top edge. A plurality of rings loosely encircle the shower curtain rod. Each ring engages one of the openings along the top of the shower curtain. In aggregate, the rings suspend the curtain from the rod in movable fashion.

Each ring has a flexible body with detachable ends. The ends include members which frictionally interengage to close the ring around the rod. An elongated part forms one of the end members. The elongated part is adapted to be received within the opening in the shower curtain. It also serves to space the ends of the ring apart a short distance, when the ring is closed, to accommodate the thickness of the shower curtain.

Conventional shower curtain rings are awkward to install. Prior to closing the ring, there is nothing to support the curtain. The weight of the curtain will tend to cause the curtain to slip off the ring. Thus, until the curtain must be supported by means other than the ring, the end members of the ring are engaged.

Thus, after the rings are placed on the rod, the curtain must be supported by the installer, with the top edge held overhead, with one hand. With the other hand, the elongated part of one ring is maneuvered into place through the corresponding curtain opening, and the end members of that ring are closed. It is necessary to continue to support the curtain with one hand, as each ring in turn is inserted and closed by the other hand. This is awkward to do.

In addition, once the curtain has been installed, if a ring should accidentally open, the corresponding portion of the curtain will fall off the elongated part of the open ring. The same two handed process will be required to support the curtain and reinsert and reclose the ring.

My improvement eliminates these difficulties by providing a ring with a means for retaining the curtain on the elongated part, and thus supporting the curtain, even before the ring is closed during installation or if the ring should accidentally open. My invention achieves this result in an extremely cost efficient and simple way.

In general, the improvement involves the use of a retaining member, preferably in the form of a flange, situated at or near the end of the elongated part. This retaining member prevents the curtain from falling off the end of the elongated part, even when the ring is not closed. This greatly facilitates installation of a shower curtain because the curtain can be first mounted on all the rings, so that its weight is distributed and supported entirely by the rings, even before any of the rings are closed. The rings can then be closed easily, as both hands are free. Moreover, if one or more rings should accidentally open, the corresponding curtain portion will not fall off the ring and sag.

It is, therefore, a prime object of the present invention to provide an improved shower curtain ring which facilitates shower curtain installation.

It is another object of the present invention to provide an improved shower curtain ring which prevents the shower curtain from falling off the ring, even if the ring accidentally opens.

It is another object of the present invention to provide an improved shower curtain ring which is made of a single, simple part which is inexpensive to fabricate and easy to use.

In accordance with one aspect of the present invention, a device for hanging a shower curtain on a shower curtain rod is provided. The shower curtain has a top edge with an opening. The hanger includes a body portion for engaging the rod. The body portion has first and second ends. First and second members are associated with the ends, respectively. One of the end members includes an elongated part adapted to extend through the curtain opening. The first and second end members frictionally interengage to close the body portion with the end members in spaced relation. The improvement comprises means for retaining the curtain on the elongated part when the end members are not engaged.

The retaining means comprises a flange on the elongated part. The elongated part has an end. The flange is situated on or near the end.

In one preferred embodiment, the end of the elongated part includes a recess. The recess is adapted to receive and frictionally engage a protrusion extending from the other end member.

Alternatively, the end of the elongated part may include a protrusion. The protrusion is adapted to be received in and frictionally engage a recess located in the other end member. The end members are preferably disk-like in configuration.

In accordance with another aspect of the present invention, a ring-like hanger is provided for attaching a shower curtain with a top edge having an opening to the shower curtain rod. The hanger includes a flexible body portion with first and second end members capable of being spread apart to permit the hanger to be mounted on the rod. First and second interengaging means are associated with the first and second end members, respectively. The interengaging means are adapted to connect the end members to close the body portion. One of the first and second means includes an elongated part adapted to be received in the curtain opening. Means associated with the elongated part are provided for retaining the curtain on the elongated part, when the interengaging means are not engaged.

The body portion includes a discontinuous ring-like element. The first and second end members each include disk-like members. The elongated part extends from one of the disk-like end members.

The retaining means includes a flange on the elongated part. The elongated part includes an end proximate the flange. In one embodiment, the elongated part end includes a recess. The other means includes a protrusion. Alternatively, the elongated part end may include a protrusion and the other means include a recess.

To these and such other objects which may hereinafter appear, the present invention relates to an improved shower curtain ring as set forth in the following specification and recited in the annexed claims, taken together with the accompanying drawings, wherein like numerals refer to like parts and in which:

FIG. 5 is a view similar to FIG. 4, but showing the ring open; and;

FIG. 6 is an isometric view of a second preferred embodiment of the present invention.

Figure 1:
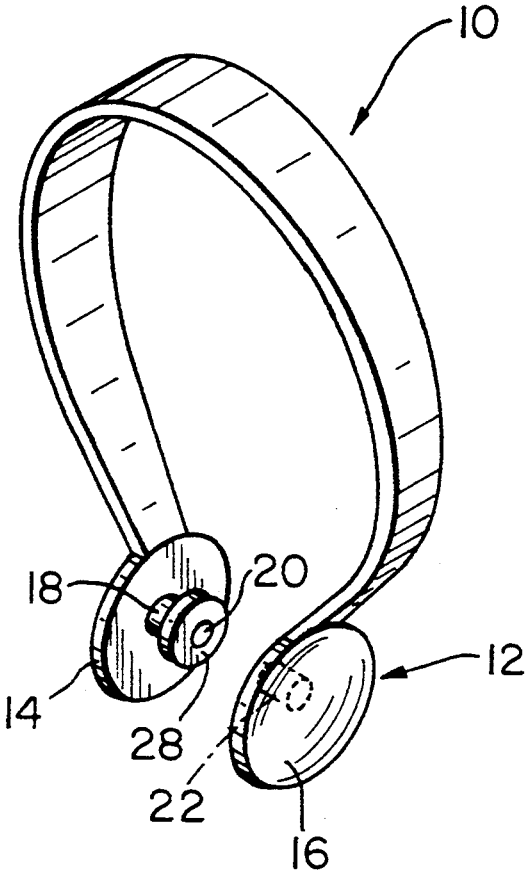
FIG. 1 is an isometric view from a first angle, showing a first preferred embodiment of the present invention.
Figure 2:
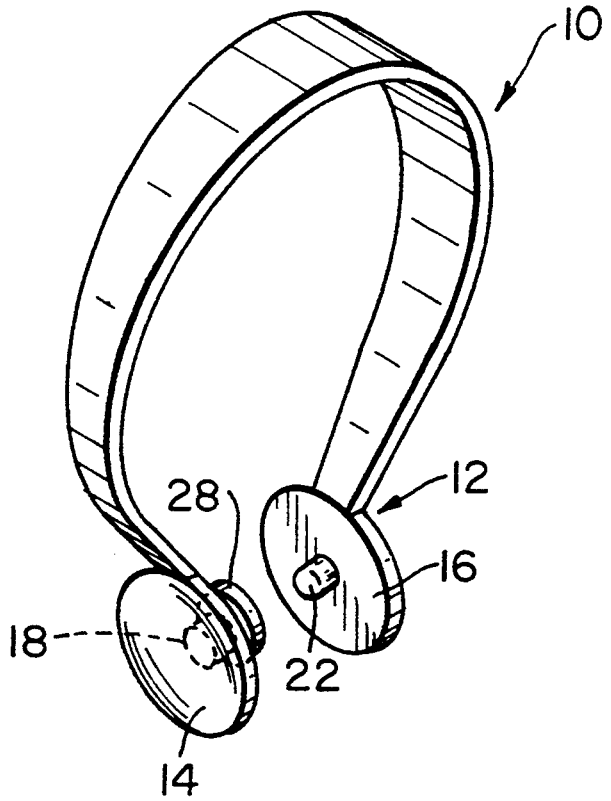
FIG. 2 is an isometric view of the invention of FIG. 1 from a second angle.
Figure 3:
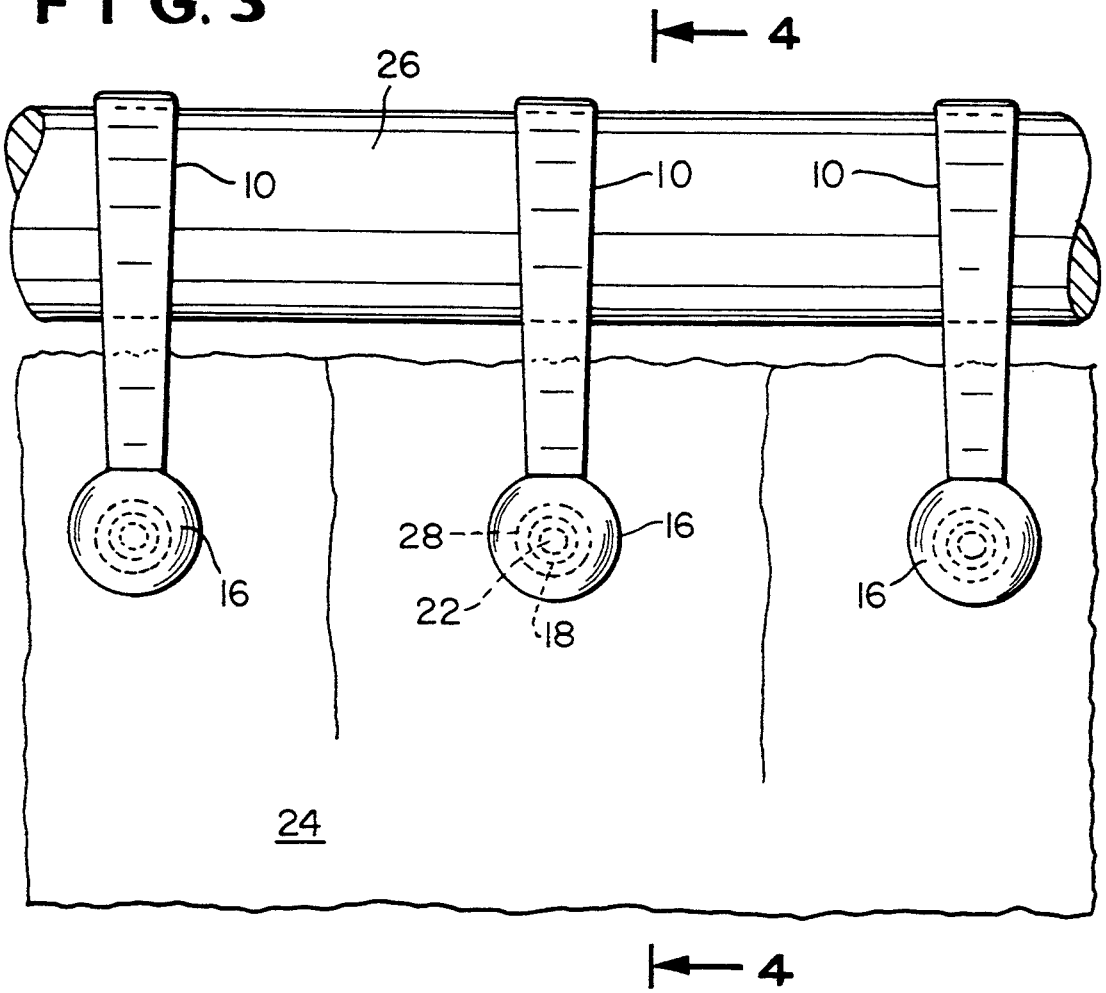
FIG. 3 is a plan view showing a section of a typical shower curtain suspended from a typical shower curtain rod by three rings of the present invention.
Figure 4:
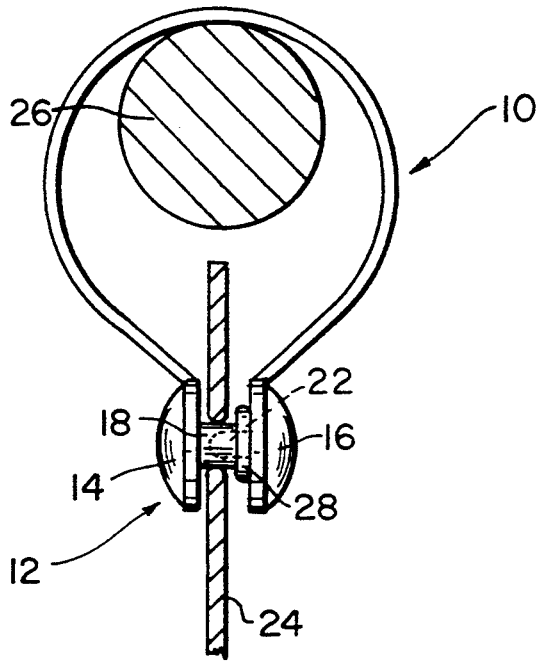
FIG. 4 is a view along line 4—4 of FIG. 3.

As seen in the drawings, the improved shower curtain ring of the present invention is preferably an integral, injection molded plastic part. The part includes a flexible body portion, generally designated 10, and interengaging means 12 for detachably closing the ends of the body 10 such that the ring encircles a shower curtain rod of conventional design.

Means 12 comprises a pair of oppositely oriented preferably disk-like end members 14, 16. A different one of the end members 14, 16 forms each of the ends of body 10. In a conventional ring, one of the end members 14 would include rod-like or cylindrical elongated part 18 extending from its interior surface. The tip of the elongated part 18 is provided with means to detachably engage the other end member 16. For example, the tip of part 18 may have a recess or opening 20 therein. A protrusion 22, extending from the end member 16, is received and frictionally retained in the recess 20 to close the ring.

When the ring is closed, end members 14, 16 are spaced apart by a distance equal to the length of part 18. Part 18 is adapted to be inserted through one of the openings spaced along the top edge of a shower curtain 24. The shower curtain will hang loosely from the ring members 14, 16 which are spaced apart by part 18 to accommodate the thickness of the shower curtain.

However, since part 18 is rod-like in configuration, when end members 14, 16 are not engaged, there is nothing preventing the curtain from slipping off the end part 18, which it will tend to do because of the considerable weight of the curtain. Accordingly, the curtain must be independently manually supported and part 18 held in the shower curtain opening during installation. Supporting the curtain and closing each ring in this way during installation is awkward.

In addition, end members 14, 16 of a shower curtain ring may accidentally disengage during use. If this happens, the corresponding portion of the curtain 24 will slip off the ring from which it was suspended. This may even cause a chain reaction where other rings are forced to open as well, due to the weight of the curtain.

I have overcome this problem in a simple and inexpensive manner. A retaining means is mounted proximate the unattached end of part 18. This retaining means is preferably in the form of a flange 28. It is small enough to easily fit through the shower curtain opening but will provide a mechanical stop to prevent the shower curtain 24 from slipping off the end of part 18 when the ring end members are not attached. The portion of the shower curtain 24 which defines the upper edge or corner of the shower curtain opening will lodge adjacent the surface of flange 28 which faces end member 14. Even if the weight of the shower curtain should pivot part 18 out of its normally horizontal orientation towards a more vertical position, the curtain will not fall off the ring because the edge of the curtain opening will engage and be retained by flange 28.

A second preferred embodiment of the invention is illustrated in FIG. 6. The second preferred embodiment differs from the first preferred embodiment only in that protrusion 22 and recess 20 are now reversed in position. Thus, in the embodiment, protrusion 22' is located on the tip of part 18, whereas the recess 20' is located in end member 6. The function of the invention is identical in both embodiments.

It should now be understood that the present invention is an improved shower curtain ring which prevents the shower curtain from slipping off the ring even when the ring is open. This facilitates installation and prevents the curtain from falling off due to accidental opening of the ring.

While only a limited number of embodiments have been disclosed herein for purpose of illustration, it is obvious that many variations and modifications could be made thereto. It is intended to cover all of these modifications and variations which fall within the scope of the invention, as defined by the following claims:

I claim:

1. In a device for hanging a shower curtain on a shower curtain rod, the shower curtain having a top edge with an opening extending completely through said top edge, the device being of the type which includes a body portion for encircling the rod and having first and second ends, a substantially rigid elongated part extending from said first end and adapted to be removably received in the shower curtain opening and means, comprising a protrusion and a recess, for detachably engaging said elongated part and said second end to close the body portion around the rod, the improvement comprising means on said elongated part for retaining the shower curtain when said second end and said elongated part are not engaged.

2. The device of claim 1 wherein said retaining means comprises a flange on said elongated part.

3. The device of claim 2 wherein said elongated part has an end and said flange is situated proximate said end.

4. The device of claim 3 wherein said engaging means comprises a recess in said elongated part end and a protrusion on said second end.

5. The device of claim 3 wherein said engaging means comprises a protrusion on said elongated part end and a recess in said second end.

6. The device of claim 1 wherein said first end comprises a disk-like member from which said elongated part extends.

7. The device of claim 1 wherein said second end comprises a disk-like member.

8. The device of claim 1 wherein said elongated part has a given cross-sectional dimension and wherein said retaining means has a cross-sectional dimension larger than said given cross-sectional dimension.

9. The device of claim 1 wherein said retaining means comprises a flange having a diameter larger than the diameter of said elongated part.

10. The device of claim 1 wherein said protrusion is mounted on and extends from said elongated part.

11. The device of claim 1 where said protrusion is mounted on proximate said retaining means.

12. In combination, a device for hanging a shower curtain on a shower curtain rod and a shower curtain having a top edge with an opening extending completely through said top edge, the device comprising a body portion for encircling the rod and having first and second ends, a substantially rigid part extending from said first end and adapted to be removably received in the said shower curtain opening, means comprising a protrusion and a recess for detachably engaging said elongated part and said second end to close said body portion around the rod, and means mounted on and extending from said elongated part for retaining said shower curtain when said second end and said elongated part are not engaged.

13. The device of claim 12 wherein said elongated part has a given cross-sectional dimension and wherein said retaining means has a cross-sectional dimension larger than said given crosssecitonal dimension.

14. The device of claim 12 wherein said retaining means comprises a flange having a diameter larger than the diameter of said elongated part.

15. The device of claim 12 wherein said protrusion is mounted on and extends from said elongated part.

16. The device of claim 12 where said protrusion is mounted on proximate said retaining means.

17. The combination of claims 12 wherein said body portion comprises a discontinuous ring-like element.

18. The combination of claim 12 wherein said first and second ends each comprise a disk-like member with an interior surface.

19. The combination of claim 18 wherein said elongated part extends from said interior surface of said disk-like member of said first end.

20. The combination of claim 19 wherein said retaining means comprises a flange on said elongated part.

21. The combination of claim 20 wherein said elongated part comprises an end and said flange is situated proximate said elongated part end.

22. The combination of claim 18 wherein said engaging means comprises a recess in said elongated part end and a protrusion on said second end member.

23. The combination of claim 18 wherein said engaging means comprises a protrusion on said elongated part end and a recess on said second end member.

24. A device for hanging a shower curtain on a shower curtain rod, the shower curtain having a top edge with an opening, the device comprising a body portion for encircling the rod and having first and second ends, a substantially rigid elongated part having a given cross-section dimension, extending from said first end and adapted to be received in the shower curtain opening, a protrusion mounted on and extending from said elongated part, a protrusion receiving recess in said second part, said protrusion and recess adapted to detachably engage to close said body portion around said rod and a flange mounted on said extending from said elongated part for retaining the shower curtain on said elongated part whether or not said protrusion and recess are engaged, said flange having a cross-sectional dimension larger than said given cross-section dimension.

* * * * *